United States Patent [19]

Schauer et al.

[11] Patent Number: 4,952,256

[45] Date of Patent: Aug. 28, 1990

[54] METHOD OF MAKING AN ELECTRICAL THROUGH CONNECTION BETWEEN A FLAT CONDUCTOR AND A ROUND CONDUCTOR

[75] Inventors: Friedrich Schauer, Heroldsberg; Hans Berthold, Eckental-Brand, both of Fed. Rep. of Germany

[73] Assignee: Kabelmetal Electro GmbH, Hanover, Fed. Rep. of Germany

[21] Appl. No.: 491,718

[22] Filed: Mar. 12, 1990

[30] Foreign Application Priority Data

Apr. 13, 1989 [DE] Fed. Rep. of Germany ..... 3912139

[51] Int. Cl.[5] ..... H01B 13/06

[52] U.S. Cl. ..... 156/49; 29/870; 29/871; 29/872; 156/48; 156/245; 174/84 R; 174/117 FF; 264/272.14; 264/272.15; 439/492

[58] Field of Search ..... 29/870, 871, 872; 156/48, 49, 245; 174/84 R, 88 R, 94 R, 117 FF; 264/272.14, 272.15; 439/492

[56] References Cited

U.S. PATENT DOCUMENTS

| | | | |
|---|---|---|---|
| 2,994,058 | 7/1961 | Dahlgren | 174/84 R |
| 3,079,458 | 2/1963 | Hedstrom | 174/84 R |
| 3,197,729 | 7/1965 | Sarazen | 174/84 R X |
| 4,654,241 | 3/1987 | Vallauri et al. | 156/49 X |
| 4,852,252 | 8/1989 | Ayer | 174/84 R X |

*Primary Examiner*—Robert A. Dawson

*Attorney, Agent, or Firm*—James C. Jangarathis

[57] ABSTRACT

A method is described for making an electrical through connection between a first conduction line comprising a flat conductor to a second conduction line comprising a round conductor. The steps of such method comprise removing end portions of insulation layer from the flat conductor and the round conductor; placing a positioning ring about the exposed end of the round conductor; bonding the round conductor to the flat conductor; extending the bonded conductors with the positioning ring into an injection molding apparatus and axially fixing the round conductor by compressive engagment of the positioning ring by a plunger element; and injecting a plastic material into the injection molding apparatus to form an insulating seal longitudinally about the bonded conductors and the positioning ring.

3 Claims, 1 Drawing Sheet

METHOD OF MAKING AN ELECTRICAL THROUGH CONNECTION BETWEEN A FLAT CONDUCTOR AND A ROUND CONDUCTOR

The invention relates to a method of making an electrical through connection between a first conduction line comprising a flat conductor, to a second conduction line comprising a round conductor; and, more particularly, to such a method employing a positioning ring placed about the round conductor prior to bonding same to the flat conductor, for axially stabilizing the round conductor as a hermetic insulating seal is injection molded thereabout.

BACKGROUND OF THE INVENTION

It is priorly known to form hermetic insulating seals about nondetachable, end-to-end connections between two or more conductors. If the respective conductors are mechanically rigid, there is little difficulty in bonding such conductors to each other, and then extending the combination within an injection molding apparatus for forming an encapsulating insulating seal longitudinally thereabout. However, if one of the conductors to be connected has a flat cross-sectional configuration of minimal thickness, considerable stability problems are presented since such flat configurations are susceptible to mechanical deformations, and in particular, to kinking. Such is especially true in the case of such a flat conductor being bonded to a round conductor, the bonded areas of which are extended in an injection molding apparatus for the formation thereabout of a hermetic insulating seal. If special handling is not provided, a kinking of the flat conductor is unavoidable at the longitudinal location it exits from its insulation. A kinking of the flat conductor represents a weakened tensile strength condition at the point of kinking, and may readily cause a rupture, tearing or breaking upon the application of tensile forces. An example of the application of such tensile forces occurs when a plastic material is injected under high pressure into an injection molding apparatus having extending therein the connecting ends of the flat and round conductors, for the formation of a hermetic insulating seal thereabout.

On occasion the engagement of the high pressure, injected insulating material with the flat conductor often causes a total break or tear at the location of the kink; and on other occasions, results in partial faults not immediately apparent but rendering the through connection unacceptable because of instability and limited longevity.

OBJECT OF THE INVENTION

The object of the present invention is to provide a novel method of making an efficient and durable electrical through connection between a flat conductor of minimal thickness and a round conductor, and injection molding a protective hermetic insulating seal thereabout.

SUMMARY OF THE INVENTION

The object of the present invention is achieved by a method of making an electrical through connection between a first conduction line comprising a flat conductor to a second conduction line comprising a round conductor. The steps of such method comprise removing end portions of insulation layer from the flat conductor and the round conductor; placing a positioning ring about the exposed end of the round conductor; bonding the round conductor to the flat conductor; extending the bonded conductors with the positioning ring into an injection molding apparatus and axially fixing the round conductor by compressive engagement of the positioning ring by a plunger element; and injecting plastic material into the injuection molding apparatus to form an insulating seal longitudinally about the bonded conductors and the positioning ring.

Further, the object of the invention is achieved by an alternative method wherein the first conduction line comprises two flat conductors and the second conduction line comprises two round conductors; and the steps of such alternative method include placing a common positioning ring about the first and second round conductors; bonding each round conductor to a corresponding flat conductor; and axially fixing, by means of the common positioning ring, each of the round conductors spatially apart in the injection molding apparatus as an insulating seal is longitudinally formed about the bonded conductors.

BRIEF DESCRIPTION OF THE DRAWINGS

A better understanding of the present invention as well as the objects and advantages thereof will become apparent upon consideration of the following disclosure thereof, especially when taken with the accompanying drawings, wherein:

Referring to FIG. 1, there is depicted an end portion of an electrical conduction line 1 from which an insulation layer 21 has been removed to expose an end portion of a flat electrical conductor 2; and an end portion of an electrical conduction line 3 from which an insulating layer 23 has been removed to expose an end portion of a round electrical conductor 4. To connect the round electrical conductor 4 to the flat electrical conductor 2, a positioning ring 5 comprised of a rigid insulating material such as polyamide, for example, is first positioned about the exposed end portion of the round electrical conductor 4. The exposed end portion of the round electrical conductor 4 is positioned longitudinally adjacent to a major face of the exposed end portion of the flat electrical conductor 2, and then bonded thereto at a connection area 8 by, for example, a soldering or welding step, to achieve an electrical through connection between such electrical conductors.

Figure 1:
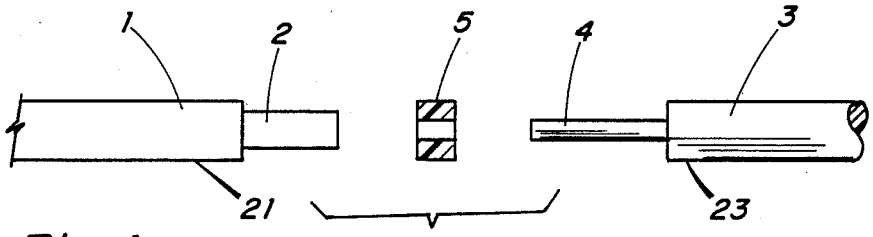
FIG. 1 is a schematic view of two electrical conduction lines the constituent conductors of which are to be connected end-to-end.
Figure 2:
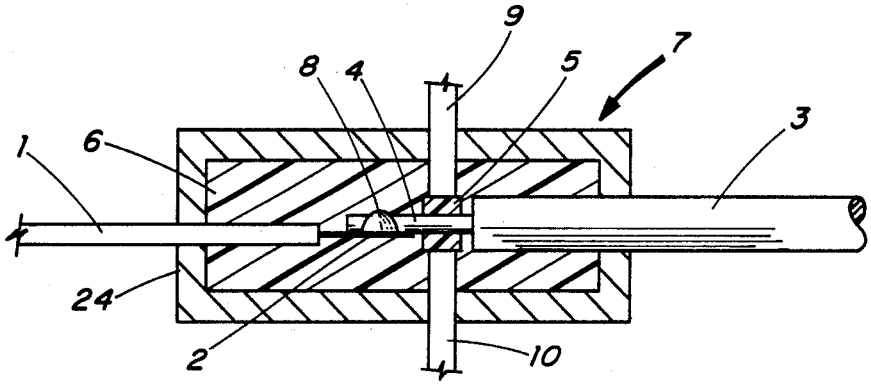
FIG. 2 is a schematic view of an injection molding apparatus within which the two electrical conduction lines of FIG. 1 are positioned.
Figure 3:
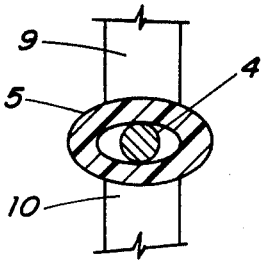
FIG. 3 is an enlarged cross-sectional view of a positioning ring detail of FIG. 2.

For the purpose of placing a hermetic insulating seal 6 about the bonded exposed ends of the flat electrical conductor 2 and the round electrical conductor 4, as well as about the positioning ring 5, such combination of elements are extended through an injection molding apparatus 7 comprising a mold 24, a first plunger element 9 and a second plunger element 10. The plunger elements 9 and 10 are aligned with respect to each other and are movable toward and away from each other, in a direction transverse to the longitudinal axis of the mold 24. The aforesaid combination of bonded elements are longitudinally moved so as to have the positioning ring 5 reside between the plunger elements 9 and 10. The plunger element 9 is moved toward and into engagement with the positioning ring 5 so as to compress the latter against the second plunger element 10, thus fixing the axial position of the portion of the round electrical conductor 4 extending through the positioning ring 5. The axial fixing of the round electrical conductor 4, in turn, causes an axial fixing of the end portion of the flat electrical conductor 2, as they are mechanically bonded to each other in the connection area 8. Further, since the exposed end portion of the round electrical conductor 4 has a rigidity greater than that of the exposed end portion of the flat electrical conductor 2, the former acts as a rigid support to the latter in the connection area 8.

A relatively flat metallic conductor of minimal thickness is usually susceptible to kinking or other mechanical deterioration upon being engaged by a plastic injection material under elevated pressure. Further, the degree of such kinking or mechanical deformation increases if the flat metallic conductor is not axially fixed and, also, is directly dependent upon the mechanical rigidity of the portion of flat metallic conductor being engaged by the plastic injection material. In the present arrangement, the axial fixing and rigid support of the end portion of the flat electrical conductor 2 prevents a kinking of such conductor upon being engaged by a plastic injection material, such as polyamide, polyurethane or polyethylene, for example. The injection of such material causes the formation of the hermetic insulating seal 6 longitudinally about the combination comprising: an end portion of the insulating layer 21; the exposed end portion of the flat electrical conductor 2 and the exposed end portion of the round electrical conductor 4 connected thereto; the positioning ring 5 compressively positioned about the conductor 4; and an end portion of the insulating layer 23.

After the formation of the hermetic insulating seal 6, the plunger elements 9 and 10 are moved away from each other and from the positioning ring 5, leaving in their stead two voids in the insulating seal 6. As the positioning ring 5 is comprised of a material which readily bonds with the material of the insulating seal 6, such positioning ring 5 closes off such voids from within, i.e., isolates the portion of the round electrical conductor 4 extending within the positioning ring 5 from the external environment. The material of the positioning ring 5 and the plastic injection material are selected especially so that they will bond or weld to each other during the injection procedure. Further, the plastic injection material is selected to bond well with the materials of the insulating layers 21 and 23, so as to achieve a complete hermetic seal about the end-to-end connection between the electrical conduction line 1 and the electrical conduction line 3.

Through the aforesaid procedure of making an electrical through connection between a single flat electrical conductor and single round electrical conductor can be readily used for making end-to-end connections between electrical conduction lines each comprising only one electrical conductor, it is advantageous to utilize the present novel method in making a multiplicity of electrical through connections between electrical conduction lines each including a plurality of such conductors.

Figure 5:
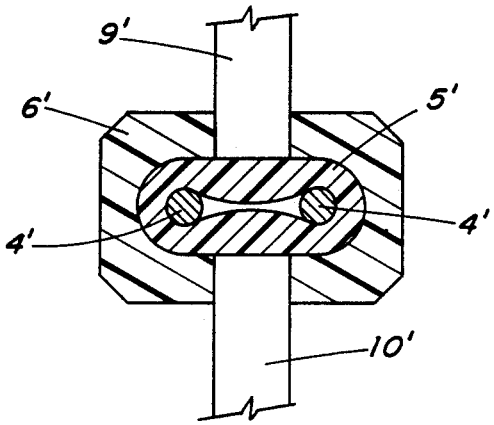
FIG. 5 is an enlarged, cross-sectional view of a positioning ring detail of FIG. 4.
Figure 4:
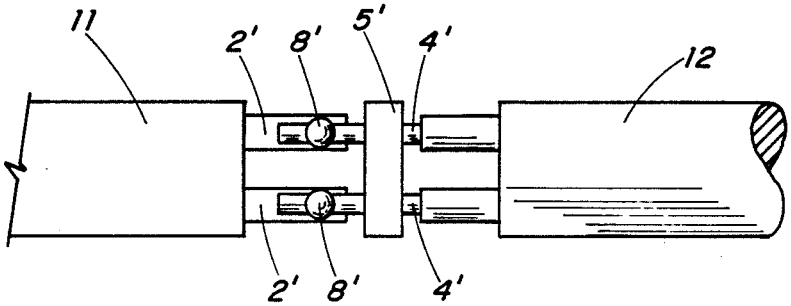
FIG. 4 is a schematic view of two electrical conduction lines, each having two constituent conductors, which are connected end-to-end.

With reference to FIG. 4, there is depicted an electrical conduction line 11 comprising two flat electrical conductors 2', 2'; and an electrical conduction line 12 comprising two round electrical conductors 4', 4'. Exposed end portions of the two round electrical conductors 4', 4'are extended through a common positioning ring 5', are placed adjacent to corresponding major faces of the exposed end portions of the two, flat electrical conductors 2', 2', and are bonded thereto by, for example, a soldering or welding step, at two connection areas 8', 8'. For the purpose of placing a hermetic insulating seal 6' (FIG. 5) about such bonded electrical conductors, such combination of elements are extended through an injection molding apparatus (not shown), similar to that as described with respect to FIG. 1, having a first plunger element 9' and a second plunger element 10' the central longitudinal axis which extends transverse to the spacial distance between the two round conductors 4', 4' The common positioning ring 5' is longitudinally positioned between the plunger elements 9' and 10', and the plunger element 9' is moved toward and into engagement with the common positioning ring 5' so as to compress the latter against the plunger element 10', thus compressing the sides of the common positioning ring 5' about and partially into the space between the two round electrical conductors 4', 4'. Consequently, each of the two round electrical conductors 4', 4' is axially fixed, which in turn causes an axial fixing of the end portion of the corresponding flat electrical conductor 2' bonded thereto. Such axial fixing and the rigid support provided to the end portion of each flat electrical conductor 2' by the round electrical conductor 4' bonded thereto, prevents a kinking of the end portions of the flat electrical conductors 2' during the subsequent injection of the plastic injection material in the formation of the hermetic insulating seal 6' thereabout.

While the invention has been described with regard to exemplary embodiments thereof, it will be understood that many modifications will be apparent to those of ordinary skill in the art and that this application is intended to cover any adaption or variation thereof. Therefore, it is manifestly intended that the invention be only limited by the claims and equivalents thereof.

What is claimed:

1. Method of making an electrical through connection between a first conduction line comprising a first flat conductor, to a second conduction line comprising a first round conductor, comprising the steps of:

removing end portions of insulation layers from said first flat conductor and said first round conductor to expose end portions thereof;

placing a positioning ring about said exposed end of said first round conductor;

bonding an end segment of said exposed end portion of said first round conductor to said exposed end portion of said first flat conductor to achieve said electrical through connection therebetween;

extending said first bonded conductors with said positioning ring, into an injection molding means, and axially fixing said first round conductor in said injection molding means by compressive engagement of said position ring by a plunger means;

injecting a plastic material into said injection molding means to form an insulating seal longitudinally about said bonded conductors and said positioning ring; and disengaging said plunger means from said positioning ring.

2. Method in accordance with claim 1, wherein said first conduction line further comprises a second flat conductor, and said second conduction line further comprises a second round conductor, further comprising the steps of removing end portions of insulation layers from said second flat conductor and said second round conductor to expose end portions thereof;

placing said positioning ring about said first and second round conductors;

bonding an end segment of said exposed end portion of said second round conductor to said exposed end portion of said second flat conductor to achieve an electrical through connection therebetween; and extending said second bonded conductors with said first bonded conductors and said positioning ring into an injection molding means, and axially fixing said second round conductor spatially apart from said first round conductor in said injection molding means by compressive engagement of said positioning ring by said plunger means having a central longitudinal axis which extends transverse to the spacial distance between said first and second round conductors.

3. Method in accordance with claim 1, wherein said positioning ring is comprised of a rigid insulating material which readily bonds to said insulating seal.

* * * * *